US006338760B1

(12) United States Patent
Landaeus et al.

(10) Patent No.: US 6,338,760 B1
(45) Date of Patent: Jan. 15, 2002

(54) METHOD IN FINAL RINSING OF DISHES IN A DISHWASHER

(75) Inventors: Kjell Landaeus, Vence (FR); Max Landaeus, Lund (SE)

(73) Assignee: G S Development AB, Malmo (SE)

( * ) Notice: Subject to any disclaimer, the term of this patent is extended or adjusted under 35 U.S.C. 154(b) by 0 days.

(21) Appl. No.: 09/230,911

(22) PCT Filed: Aug. 20, 1997

(86) PCT No.: PCT/SE97/01364

§ 371 Date: Oct. 4, 1999

§ 102(e) Date: Oct. 4, 1999

(87) PCT Pub. No.: WO98/08428

PCT Pub. Date: Mar. 5, 1998

(30) Foreign Application Priority Data

Aug. 30, 1996 (SE) ..... 9603150

(51) Int. Cl.[7] ..... B08B 7/04; B08B 3/00; B08B 3/10

(52) U.S. Cl. ..... 134/18; 134/25.2; 134/57 D; 134/58 D; 134/107; 134/113

(58) Field of Search ..... 134/18, 25.2, 57 D, 134/58 D, 107, 113

(56) References Cited

U.S. PATENT DOCUMENTS 3,762,395 A 10/1973 Taylor 5,137,053 A 8/1992 Kale

FOREIGN PATENT DOCUMENTS

| | | |
|---|---|---|
| GB | 926270 | 5/1963 |
| WO | 9204856 | 4/1992 |

OTHER PUBLICATIONS

Derwent's abstract, SU 1358925, Dec. 15, 1987.

*Primary Examiner*—Zeinab El-Arini
(74) *Attorney, Agent, or Firm*—James Ray & Associates

(57) ABSTRACT

A method is provided for final rinsing in a dish washing machine with clean hot water from a water heater having an elongated standing flow tank which has a cold water inlet with a shut-off valve at the bottom and a hot water outlet at the top and a heating element in the lower part. The temperature of the water is sensed at a location above the lower end of the tank. The shut-off valve is opened for supply of cold water under pressure to the lower end of the tank. Hot water is delivered from the upper end of the tank. The period from opening of the shut-off valve to the time of sensing a temperature decrease in a boundary layer between hot and cold water at the above-mentioned location is measured and on the basis thereof the flow and the period for movement of the boundary layer from this location to a desired position in the tank is calculated.

4 Claims, 1 Drawing Sheet

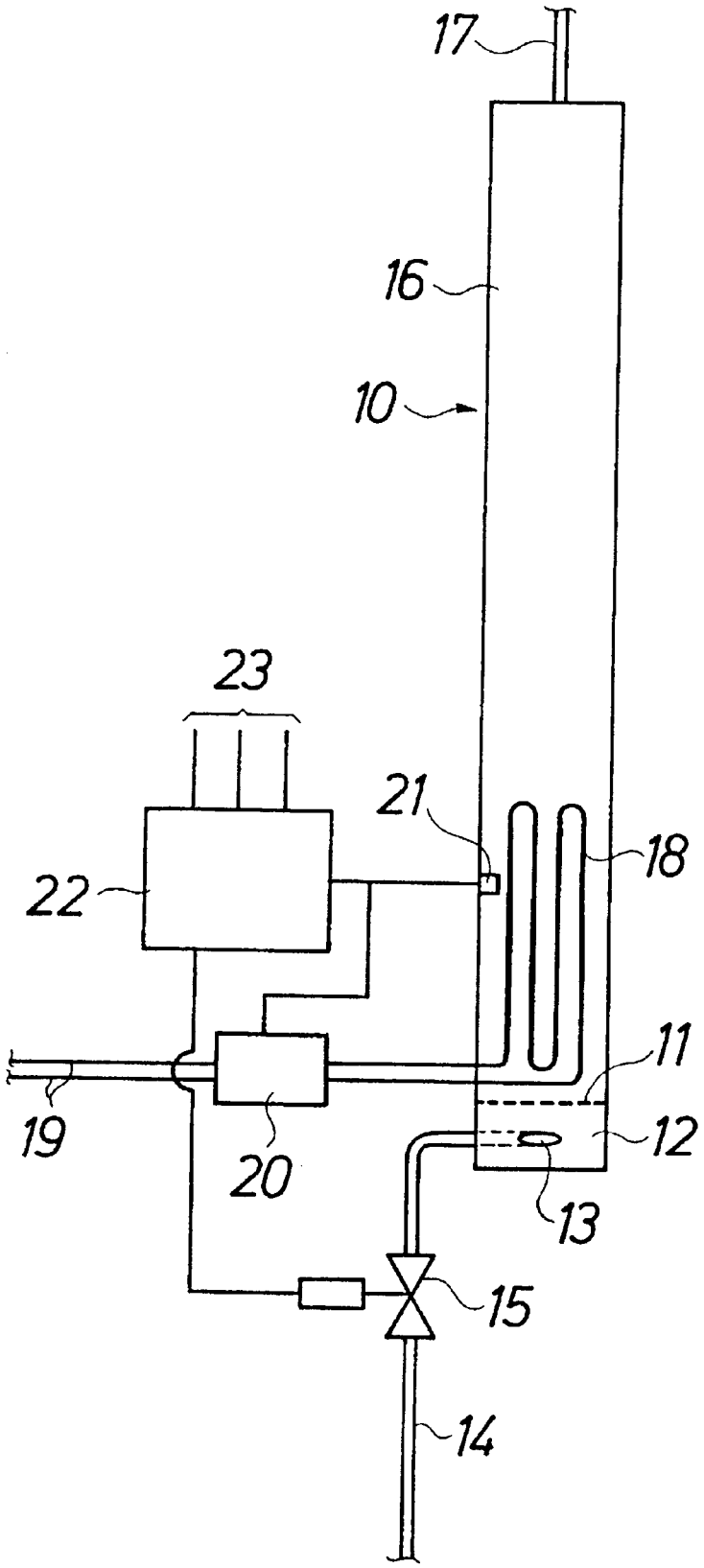
17
16
10
23
21
18
22
11
19
20
12
13
15
14

METHOD IN FINAL RINSING OF DISHES IN A DISHWASHER

This is a national stage application of PCT/SE97/01364 filed Aug. 20, 1997.

FIELD OF THE INVENTION

The invention relates to a method for final rinsing of goods to be cleaned in a dish washing machine, the final rinsing being effected with clean hot water supplied from a water heater.

BACKGROUND OF THE INVENTION

In order to satisfy hygienic requirements, it is requested in some countries that the final rinsing shall take place at constant temperature with a predetermined volume of water for a predetermined period. As far as these three operational parameters for the final rinsing are concerned, the standards are different in different countries. Also wants regarding the operational parameters may vary from one user to the other.

The water heaters which today normally are mounted in dish washing machines for final rinsing with clean hot water as the last step in a dish washing cycle are, however, of a construction which does not allow final rinsing with the above-mentioned values of the parameter temperature, volume, and period, and thus do not satisfy the standards. The water heaters moreover are rather space demanding. They have a laying flow tank with a heating element mounted in the lower half of the flow tank which has the water inlet in one end wall and the hot water outlet in the other end wall. The water is kept at a sufficiently high temperature in the tank, and there is accordingly at the beginning of the final rinsing a certain amount of water at the required temperature available in the tank. When the final rinsing is started water is supplied under pressure at the water inlet from an existing water distribution system and the water supplied usually is water from a distribution system, which is at about 55° C., but nevertheless will be called cold water herein in order to differentiate said water from the much warmer water which is supplied by the water heater and is called hot water. When water is supplied to the tank, the hot water in the tank will be expelled therefrom to nozzles in the dish washing machine in order to sprinkle the goods to be cleaned, but already after a short period the temperature of the water in the tank has decreased below the predetermined value. This is due to the fact that the water flowing into the tank at the temperature 55° C., which replaces the delivered rinsing water, mixes with the rinsing water already heated in the tank.

In the method according to the invention this drawback of prior art water heaters is eliminated by the hot water being supplied from a water heater having an elongated standing flow tank which has a cold water inlet with a shut-off valve at the lower end and a hot water outlet at the upper end, and heating elements inside the flow tank in the lower part thereof for heating the water in the flow tank. This type of water heater is basically known as disclosed for example in U.S. Pat. No. 5,137,053.

In such a water heater there is obtained a quieter flow in the flow tank, the water already heated being "lifted" in the flow tank and is discharged in the upper end thereof with a distinct and limited boundary layer between the hotter water and the incoming colder water which quietly rises in the flow tank below the boundary layer.

In order that a predetermined amount of hot water at a predetermined temperature shall be supplied during the rinsing procedure, it is required, however, that the boundary layer is located at a predetermined level in the flow tank when the supply of cold water is shut off and the delivery of hot water thus will be interrupted, which presupposes that the flow through the flow tank always is the same if the rinsing procedure is time controlled, that is if the shut-off valve for the supply of cold water to the flow tank is kept open for a predetermined period which is always the same for delivery of hot water from the water heater. Since the pressure of the cold water varies i.e. either it is taken from a municipal water distribution system or from a private water supply it will, however, be unavoidable that the boundary layer at such time control of the cold water supply will be located below said predetermined level in the flow tank if the pressure of the cold water is lower than the pressure for which the period during which the shut-off valve is to be kept open has been calculated so that a too small amount of hot water will be delivered from the water heater, or that also the boundary layer and colder water located below said layer in the flow tank will be delivered from the upper end of the flow tank so that stipulated requirements regarding the temperature of the water for final rinsing cannot be fulfilled in case the pressure of the cold water supplied is higher than the value assumed for calculating the period during which the shut-off valve is to be kept open.

It is possible to overcome the disadvantages following variations of the pressure of the cold water by providing a pressure maintaining valve between the shut-off valve and the cold water inlet at the lower end of the flow tank but this means that there is included in the system a sensitive component which moreover includes additional costs which are not unimportant.

SUMMARY OF THE INVENTION

A method is provided for final rinsing in a dish washing machine with clean hot water from a water heater having an elongated standing flow tank which has a cold water inlet with a shut-off valve at the bottom and a hot water outlet at the top and a heating element in the lower part. The temperature of the water is sensed at a location above the lower end of the tank. The shut-off valve is opened for supply of cold water under pressure to the lower end of the tank. Hot water is delivered from the upper end of the tank. The period from opening of the shut-off valve to the time of sensing a temperature decrease in a boundary layer between hot and cold water at the above-mentioned location is measured and on the basis thereof the flow and the period for movement of the boundary layer from this location to a desired position in the tank is calculated.

BRIEF DESCRIPTION OF THE DRAWING

The drawing discloses diagrammatically a final rinsing device for application of the method.

DETAILED DESCRIPTION OF THE INVENTION

The water heater in the shown final rinsing device comprises a standing cylindrical flow tank 10 which in a preferred embodiment can have a height of about 1.4 m and a diameter of 100–120 mm corresponding to a volume of about 15 l. In the lower part of the tank near the bottom thereof there is provided a partition in the shape of a diffuser 11 consisting of a perforated metal sheet having perforation apertures which are of the order of 2 mm and are arranged close to each other so that the perforated metal sheet has a high perforation degree. Several metal plates of this type can be provided one on top of the other, and it is also possible to provide, instead of a perforated partition, a wad of steel wool or another porous body having open pores, or the like. The main thing is that the diffuser provides a uniform speed profile over the cross-sectional area of the tank. Between the diffuser 11 and the bottom of the tank there is defined an inlet chamber 12 including a water inlet 13 opening into the inlet chamber for the supply of water tangentially therein. The inlet 13 is connected to a conduit 14 which is connected with a water distribution system wherein the water is at a temperature of about 55° C. A solenoid controlled shut-off valve 15 is provided in the conduit 14. Above the diffuser 11, the tank forms a store chamber 16, and the top the tank is provided with an outlet 17 to be connected to nozzles in the dish washing machine.

An electric heating loop 18 is provided in the store chamber 16 substantially centrally in the tank. This heating loop extends over only a shorter lower portion of the tank, preferably over a distance which is ⅓of the length of the tank or less. The heating loop shall be shaped such that it does not interfere with laminar flow in the tank. The heating loop is connected to electric mains 19 via a contactor 20 for switching on and off the current to the heating loop.

A temperature sensor 21 is provided in the tank in the region of the heating loop, preferably in the region of the upper third of the heating loop, and this temperature sensor is connected to the contactor 20 to keep the heating element switched on as required in order that the water in the tank shall be heated to a predetermined, preferably adjustable temperature, for example a temperature which is at least 85° C. The temperature sensor 21 is also connected with a computerized programmer 22 in the dish washing machine, which has connections 23 to different components in the machine for controlling the dish washing cycle thereof and is also connected to the solenoid valve 15.

When the device described is operating, water in the store chamber 16 of the flow tank 10 is heated by means of the heating loop 18 to a temperature which is at least 85° C. When a final rinsing is to be performed in the dish washing machine, the solenoid valve 15 is opened so that cold water can flow through the conduit 14 to the water inlet 13 and from there into the inlet chamber 12. A whirling movement is imparted to the incoming water in the inlet chamber 12 in order to distribute the water therein below the diffuser 11, but after passage through the diffuser, the water will rise quietly through the store chamber 16 in a substantially laminar flow. Then, a distinct and limited boundary layer will be maintained between the incoming cold water at about 55° C. and the heated water in the store chamber 16 at a temperature of at least 85° C. so that this hotter water, without being mixed with and cooled down by the incoming water at the temperature, will be quietly lifted in the store chamber 16. The temperature sensor continuously measures the temperature of the water when it flows through the tank. Software included in the computerized programmer can compensate for delay in the measuring system, if any. By means of software there is effected also registration of the period from opening of the solenoid valve 15 to the time at which the temperature sensor 21 senses a temperature decrease representing the boundary layer between cold and hot water in the flow tank 10, as well as calculation of the flow in the tank on the basis of the recorded period. The software then calculates the period during which the solenoid valve must be open for the boundary layer to be lifted to a desired position in the flow tank, which corresponds to a desired delivered volume of hot water, the solenoid valve then being closed. Then, a predetermined volume of water has been delivered at a predetermined temperature of at least 65° C. independently of the pressure of the cold water supplied in the conduit 14. The delivered hot water is sprinkled from the nozzles over the goods to be cleaned during the final rinsing which usually is the last step in a dish washing cycle. The software can also contain parameters for satisfying for example certain requirements regarding the final rinsing period.

When the final rinsing has been completed, the tank will of course be full of water at 55° C. which is then heated to 85° C. after which the final rinsing cycle can be repeated.

What is claimed is:

1. Method in final rinsing of goods to be cleaned in a dish washing machine wherein the final rinsing is effected with clean hot water supplied from a water heater having an elongated standing flow tank which has a cold water inlet with a shut-off valve at a lower end and a hot water outlet at an upper end, and a heating element inside the flow tank in a lower portion thereof for heating water in the flow tank, said method comprising the steps of:

(a) sensing a temperature of the water in the lower portion of the flow tank at a location above the lower end of the flow tank;

(b) initiating a final rinsing procedure by opening the shut-off valve for the supply of cold water under pressure to the flow tank at the lower end thereof while at the same time delivering hot water from the upper end of the flow tank;

(c) measuring a period which extends from opening of the shut-off valve to a time at which there is sensed at said location a temperature decrease representing a boundary layer between hot and cold water in the flow tank;

(d) calculating the flow in the flow tank on a basis of the measured period to determine the period which is required for displacement of said boundary layer at the calculated flow from said location to a desired position in the flow tank corresponding to a desired delivered volume of hot water; and (e) closing the shut-off valve and interrupting the delivery of hot water from the upper end of the flow tank accordingly after said calculated period.

2. Method as in claim 1 wherein the cold water is supplied to the flow tank at the lower end thereof via a diffuser.

3. Method as in claim 2 wherein a whirling movement about a longitudinal axis of the flow tank is imparted to the cold water during supply thereof to the lower end of the flow tank.

4. Method as in claim 1 wherein a whirling movement about a longitudinal axis of the flow tank is imparted to the cold water during supply thereof to the lower end of the flow tank.

* * * * *